US005641137A

United States Patent [19]

Collier

[11] Patent Number: 5,641,137

[45] Date of Patent: Jun. 24, 1997

[54] BAG DRYER

[76] Inventor: Jackson D. Collier, 8920 Alliston Hollow Way, Gaithersburg, Md. 20879

[21] Appl. No.: 509,434

[22] Filed: Jul. 31, 1995

[51] Int. Cl.[6] ..... F26B 25/00

[52] U.S. Cl. ..... 248/95; 248/97; 248/166; 211/71; 211/81; 211/85; 211/200; 211/12

[58] Field of Search ..... 248/95, 97, 166; 211/71, 81, 85, 195, 200, 12, 13

[56] References Cited

U.S. PATENT DOCUMENTS

| | | | |
|---|---|---|---|
| 63,383 | 4/1867 | Hanks | 248/97 |
| 359,641 | 3/1887 | Spafford | 248/97 |
| 4,646,802 | 3/1987 | Basore et al. | 248/97 X |
| 5,080,237 | 1/1992 | Hefner | 248/95 X |
| 5,082,121 | 1/1992 | Grubb | 211/195 X |
| 5,188,244 | 2/1993 | Hollstegge | 211/13 X |
| 5,247,752 | 9/1993 | Gyr et al. | 211/196 X |

FOREIGN PATENT DOCUMENTS

| | | | |
|---|---|---|---|
| 75581 | 6/1894 | Germany | 248/97 |

*Primary Examiner*—Ramon O. Ramirez
*Assistant Examiner*—Brian J. Hamilla

[57] ABSTRACT

A bag dryer including a plurality of elongated dowels with each dowel having an exterior end, an interior end and a hole radially positioned therethrough with a common distance from the interior end; a pair of generally rectangular base portions with each base having an interior edge with a plurality of holes therein, an exterior edge for placement upon a recipient surface, and a pair of short end walls and a pair of long side walls therebetween, each hole capable of being in receipt of the interior end of each dowel; and a plurality of rivets for positioning through each hole of each dowel joining the dowels forming dowel pairs, the dowel pairs being in an open position when each base portion being placed on the recipient surface and capable of receipt of a bag over each exterior end of each dowel of the dowel pairs.

7 Claims, 3 Drawing Sheets

BAG DRYER

BACKGROUND OF THE INVENTION

1. Field of the Invention

The present invention relates to a bag dryer and more particularly pertains to providing a folding stand for drying all sizes of storage bags when the dryer is placed in an expanded operable configuration with a wet bag hung in an open position over a dowel and further allowing a variety of bags of various sizes to be dried at the same time on the bag dryer.

2. Description of the Prior Art

The use of bag dryers is known in the prior art. More specifically, bag dryers heretofore devised and utilized for the purpose of hanging bags up to dry are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,080,237 to Hefner discloses a holder for washing and drying bags that is made of a holder with segmented arms pivotally joined which hold one bag in an inverted position to allow the bag to be sprayed with water for cleaning and then air dry. U.S. Pat. No. 5,121,842 to Osborne discloses a cap tree apparatus. U.S. Pat. No. 5,188,244 to Hollstegge discloses a dryer rack for freezer bags and like articles with a rack structure. U.S. Pat. No. Des. 342,357 to Balk discloses a bag dryer with a hanger like configuration. Lastly, U.S. Pat. No. 5,303,827 to Ross discloses a plastic bag drying rack having a tree like configuration with semicircular arcuate support rods.

In this respect, the bag dryer according to the present invention substantially departs from the conventional concepts and designs of the prior art, and in doing so provides an apparatus primarily developed for the purpose of providing a folding stand for drying all sizes of storage bags when the dryer is placed in an expanded operable configuration with a wet bag hung in an open position over a dowel and further allowing a variety of bags of various sizes to be dried at the same time on the bag dryer.

Therefore, it can be appreciated that there exists a continuing need for a new and improved bag dryer which can be used for providing a folding stand for drying all sizes of storage bags when the dryer is placed in an expanded operable configuration with a wet bag hung in an open position over a dowel and further allowing a variety of bags of various sizes to be dried at the same time on the bag dryer. In this regard, the present invention substantially fulfills this need.

SUMMARY OF THE INVENTION

In view of the foregoing disadvantages inherent in the known types of bag dryers now present in the prior art, the present invention provides an improved bag dryer. As such, the general purpose of the present invention, which will be described subsequently in greater detail, is to provide a new and improved bag dryer and method which has all the advantages of the prior art and none of the disadvantages.

To attain this, the present invention essentially comprises a plurality of elongated cylindrical dowels of rigid material. Each dowel having an exterior end, an interior end and a hole radially positioned therethrough with a common distance from the interior end. The dowels have a length wherein a first set of two pair of dowels are of an equal length and a second set of two pair of dowels have a graduating length greater than the first set and a third set of three pair of dowels have a graduating length greater than the second set of dowels. A pair of base portions are included. The pair of generally rectangular base portions of rigid material form a first base and a second base. Each base has an interior edge with a plurality of holes therein, an exterior edge for placement upon a recipient surface, and a pair of short end walls and a pair of long side walls therebetween. Each hole has a diameter of a size for slidable receipt of the interior end of each dowel. Each hole has a depth for receipt of about ten percent of the length of each dowel. Lastly, a plurality of rivets of rigid material for positioning through each hole of each dowel are included. The rivets rotatably joining together the pair of dowels of each set. The rivets allow the pair of dowels to align parallel to each other when in a closed position. The rivets further allow the pair of dowels to form an "X" configuration when in an open position. The pair of dowels are in the open position when one of the pair has the interior end positioned in the first base and another of the pair has the interior end positioned in the second base and the exterior edges of the pair of base portions being positioned apart therefrom on a recipient surface. The dowels are capable of slidable receipt of a bag over the exterior end.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bag dryer which has all of the advantages of the prior art bag dryers and none of the disadvantages.

It is another object of the present invention to provide a new and improved bag dryer which may be easily and efficiently manufactured and marketed.

It is further object of the present invention to provide a new and improved bag dryer which is of durable and reliable constructions.

An even further object of the present invention is to provide a new and improved bag dryer which is susceptible of a low cost of manufacture with regard to both materials and labor, and which accordingly is then susceptible of low prices of sale to the consuming public, thereby making such Bag dryer economically available to the buying public.

Still yet another object of the present invention is to provide a new and improved bag dryer which provides in the apparatuses and methods of the prior art some of the advantages thereof, while simultaneously overcoming some of the disadvantages normally associated therewith.

Even still another object of the present invention is to provide a new and improved bag dryer for providing a folding stand for drying all sizes of storage bags when the dryer is placed in an expanded operable configuration with a wet bag hung in an open position over a dowel and further allowing a variety of bags of various sizes to be dried at the same time on the bag dryer.

Lastly, it is an object of the present invention to provide a new and improved bag dryer comprising a plurality of elongated dowels with each dowel having an exterior end, an interior end and a hole radially positioned therethrough with a common distance from the interior end; a pair of generally rectangular base portions with each base having an interior edge with a plurality of holes therein, an exterior edge for placement upon a recipient surface, and a pair of short end walls and a pair of long side walls therebetween, each hole capable of being in receipt of the interior end of each dowel; and a plurality of rivets for positioning through each hole of each dowel joining the dowels forming dowel pairs, the dowel pairs being in an open position when each base portion being placed on the recipient surface and capable of receipt of a bag over each exterior end of each dowel of the dowel pairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
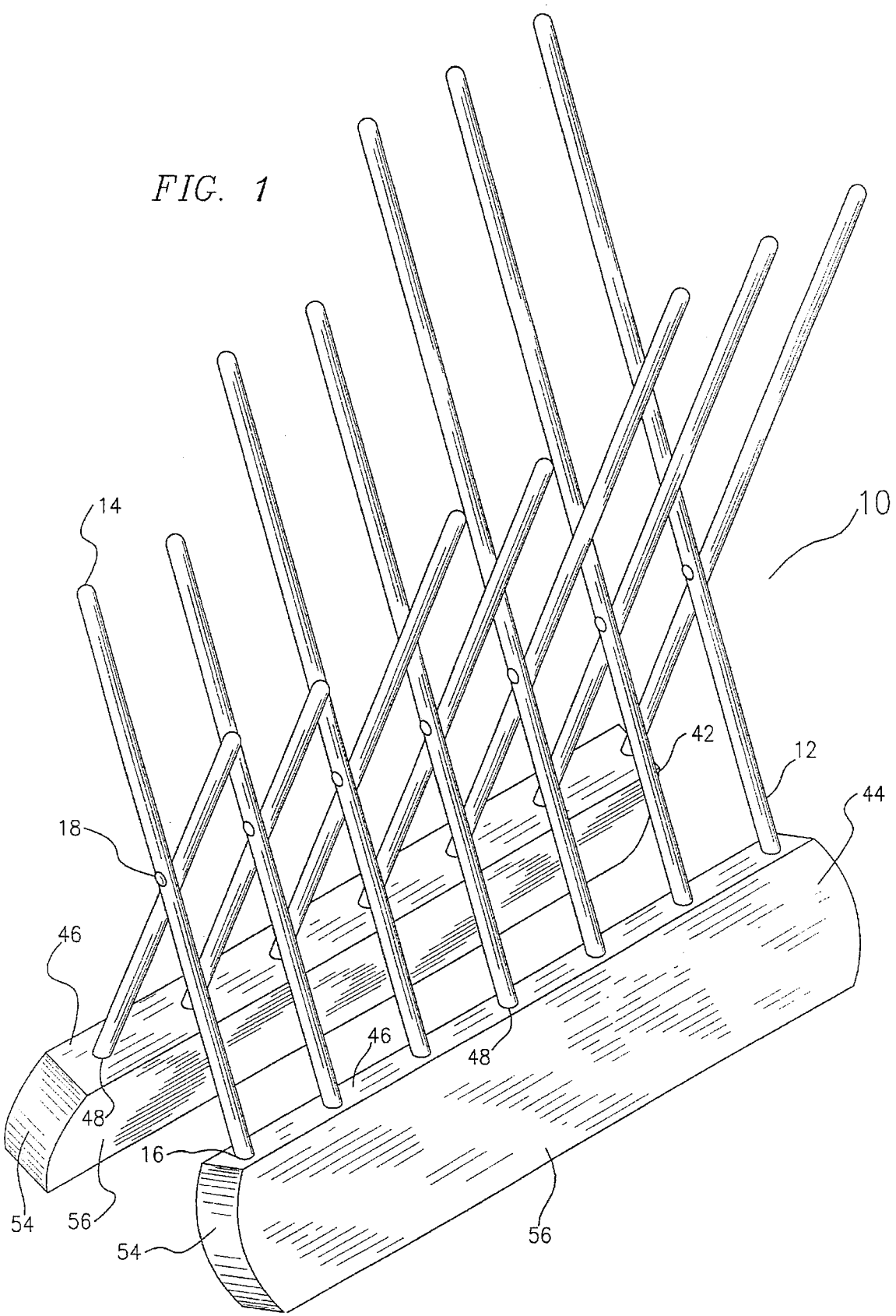
FIG. 1 is a perspective view of the preferred embodiment of the bag dryer constructed in accordance with the principles of the present invention.

With reference now to the drawings, and in particular to FIG. 1 thereof, the preferred embodiment of the new and improved Bag dryer embodying the principles and concepts of the present invention and generally designated by the reference numeral 10 will be described.

The present invention, the bag dryer 10 is comprised of a plurality of components. Such components in their broadest context include dowels, a pair of base, and rivets. Such components are individually configured and correlated with respect to each other so as to attain the desired objective.

Figure 2:
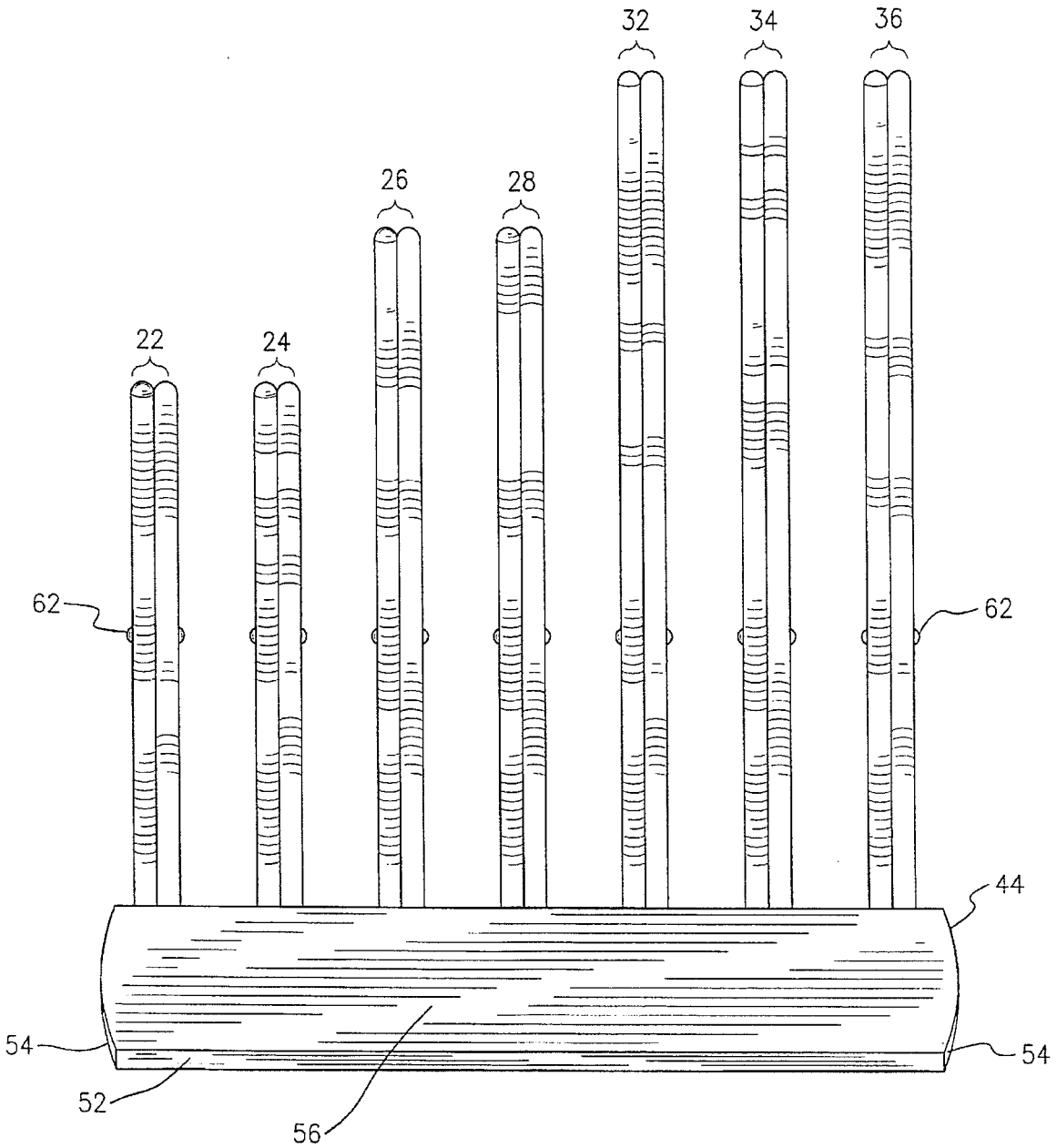
FIG. 2 is a side view of the present invention.

Specifically, the present invention includes a plurality of elongated cylindrical dowels 12 as shown in FIG. 1. Each dowel is formed of rigid material such as wood or plastic. Each dowel has an exterior end 14, an interior end 16 and a hole 18 radially positioned therethrough with a common distance from the interior end. As best illustrated in FIG. 2, the dowels having a length wherein a first set, 22 and 24, of two pair of dowels are of an equal length and a second set, 26 and 28, of two pair of dowels being of a graduating length greater than the first set and a third set, 32, 34, and 36, of three pair of dowels being of a graduating length greater than the second set of dowels. The dowels provide a holder for the bags.

Figure 3:
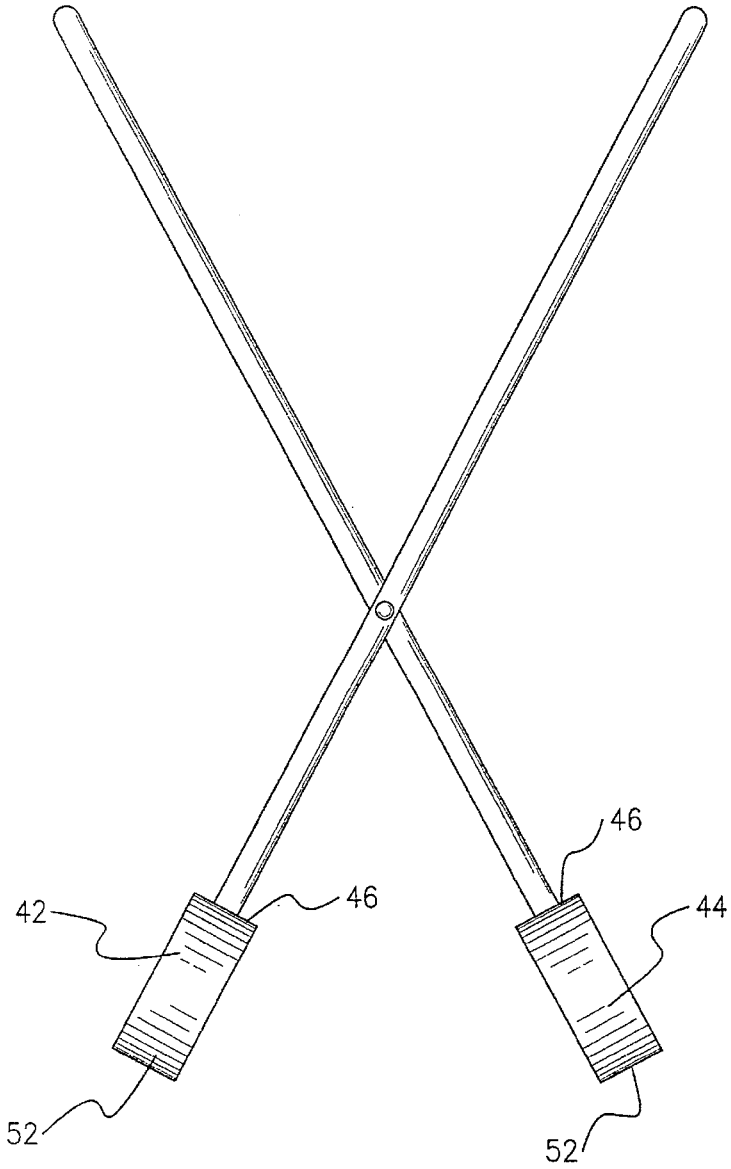
FIG. 3 is a front view of the present invention in an expanded operable configuration.

Also included is a pair of base portions, 42 and 44, as shown in FIG. 1. Each pair of base portions have generally rectangular configuration and are formed of a rigid material such as wood or plastic. The base portions form a first base 42 and a second base 44 as shown in FIG. 3. Each base has an interior edge 46 with a plurality of holes 48 therein, an exterior edge 52 for placement upon a recipient surface, and a pair of short end walls 54 and a pair of long side walls 56 therebetween. Each hole has a diameter of a size for slidable receipt of the interior end of each dowel. Each hole has a depth for receipt of about ten percent of the length of each dowel. The base portions support the dowels. It is very important that the hole depth is about ten percent so that the dowels are secured within.

Figure 4:
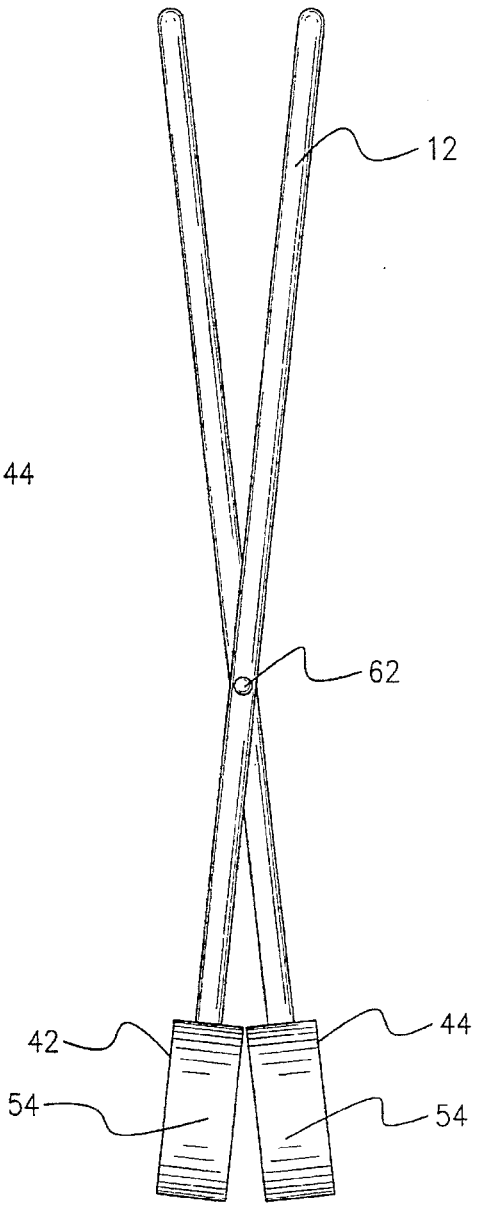
FIG. 4 is a front view of the present invention in a closed configuration.

Lastly, a plurality of rivets 62 is included. The rivets are formed of rigid material such as metal or metal alloy, more particularly brass. Brass is preferable because of its resistance to oxidation. The rivets are positioned through each hole 18 of each dowel 12 as shown in FIG. 2. The rivets rotatably joining together the pair of dowels of each set 22, 24, 26, 28, 32, 34 and 36. The rivets allow the pair of dowels to align parallel to each other when in a closed position as shown in FIG. 4. The rivets further allow the pair of dowels to form an "X" configuration when in an open position as shown in FIG. 3. The pair of dowels being in the open position when one of the pair has its interior end positioned in the first base 42 and another of the pair has its interior end being position in the second base 44 and the exterior edge 52 of each base portion is positioned apart therefrom on a recipient surface. The dowels are capable of slidable receipt of a bag over the exterior end 14. The bags hang upside down over the dowels, to allow the moisture to drip down and air to pass within, for drying.

The present invention is a folding bag dryer that has a plurality of dowels that enable bags to be hung on them in an upside down position. The dryer is made from a pair of wooden bases and dowels and brass rivets. The wooden bases hold the dowels in an upright position. The dowels are connected in sets of two with the rivets screwed through the dowels. The bases are placed on a kitchen counter with one of the set of dowels sticking up from a base. The bases are pulled away from each other causing the sets of dowels to form an "X" configuration. When the dowels are in the "X" configuration the bags are hung upside down over the ends of the dowels. The bags will drain and dry since they are held open by the dowels. The present invention thus provides a folding bag dryer that is convenient and easy to use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved Bag dryer comprising, in combination:

a plurality of elongated cylindrical dowels of rigid material, each dowel having an exterior end, an interior end and a hole radially positioned therethrough with a common distance from the interior end, the dowels having a length wherein a first set of two pair of dowels are of an equal length and a second set of two pair of dowels being of a graduating length greater than the first set and a third set of three pair of dowels being of a graduating length greater than the second set of dowels;

a pair of generally rectangular base portions of rigid material forming a first base and a second base, each base having an interior edge with a plurality of holes therein, an exterior edge for placement upon a recipient surface, and a pair of short end walls and a pair of long side walls therebetween, each hole having a diameter of a size for slidable receipt of the interior end of each dowel, each hole having a depth for receipt of about ten percent of the length of each dowel; and a plurality of rivets of rigid material for positioning through each hole of each dowel, the rivets rotatably joining together the pair of dowels of each set, the rivets allow the pair of dowels to align parallel to each other when in a closed position, the rivets further allowing the pair of dowels to form an "X" configuration when in an open position, the pair of dowels being in the open position when one of the pair having the interior end being positioned in the first base and another of the pair having the interior end being position in the second base and the exterior edge of each base portion being positioned apart therefrom on recipient surface, the dowels being capable of slidable receipt of a bag over the exterior end.

2. A bag dryer comprising:

a plurality of elongated dowels with each dowel having an exterior end, an interior end and a hole radially positioned therethrough with a common distance from the interior end, the dowels further have a length wherein a first set of two pair of dowels are of equal length and a second set of two pair of dowels are of a graduating length greater than the first set and a third set of three pair of dowels being of a graduating length greater than the second set of dowels;

a pair of generally rectangular base portions with each base portion having an interior edge with a plurality of holes therein, an exterior edge for placement upon a recipient surface, and a pair of short end walls and a pair of long side walls therebetween, each hole capable of being in receipt of the interior end of each dowel; and a plurality of rivets for positioning through each hole of each dowel joining the dowels forming dowel pairs, the dowel pairs being in an open position when each base portion being placed on the recipient surface and capable of receipt of a bag over each exterior end of each dowel of the dowel pairs.

3. A bag dryer as set forth in claim 2 wherein the dowels are cylindrical and are formed of a rigid material.

4. A bag dryer as set forth in claim 2 wherein the base portions are made of a rigid material and form a first base and a second base.

5. A bag dryer as set forth in claim 2 wherein each hole of each base portion has a diameter sized for slidable receipt of each dowel and a depth for receipt of about ten percent of a length of each dowel.

6. A bag dryer as set forth in claim 2 wherein the rivets are formed of rigid material are allow the pairs of dowels to align parallel to each other in a closed position.

7. A bag dryer as set forth in claim 2 wherein the rivets further allow the pairs of dowels to form an "X" configuration in the open position when the pair of base portions are spaced apart and the interior end of one dowel of the dowel pairs is positioned in one of the base portions and the interior end of another dowel of the dowel pairs is positioned in another of the base portions.

* * * * *